US008050577B2

(12) United States Patent
Choi

(10) Patent No.: US 8,050,577 B2
(45) Date of Patent: Nov. 1, 2011

(54) IMAGE FORMING APPARATUS AND ABNORMAL TEMPERATURE DETERMINATION CONTROLLING METHOD

(75) Inventor: Ho Young Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/652,305

(22) Filed: Jan. 5, 2010

(65) Prior Publication Data

US 2010/0172661 A1 Jul. 8, 2010

(30) Foreign Application Priority Data

Jan. 6, 2009 (KR) ..... 10-2009-0000709

(51) Int. Cl.
*G03G 15/20* (2006.01)

(52) U.S. Cl. ..... 399/33; 399/69

(58) Field of Classification Search ..... 399/9, 33, 399/38, 67–70, 107, 110, 222; 219/216, 219/489

See application file for complete search history.

(56) References Cited

FOREIGN PATENT DOCUMENTS

| | | | |
|---|---|---|---|
| JP | 58129450 A | * | 8/1983 |
| JP | 2001194948 A | * | 7/2001 |
| JP | 2004126190 A | * | 4/2004 |
| JP | 2008-15012 | | 1/2008 |

* cited by examiner

*Primary Examiner* — David Porta
*Assistant Examiner* — Milton Gonzalez
(74) *Attorney, Agent, or Firm* — Staas & Halsey LLP

(57) ABSTRACT

An image forming apparatus and a controlling method thereof. The image forming apparatus includes a fixing member having a heating source to heat a developer of a recording medium, a power supply unit to the heating source, first and second temperature sensors for respective first and second positions on the fixing member, a width sensor for the recording medium, and a control unit, when a difference between the first temperature and the second temperature is greater than a predetermined reference value, determining whether the first temperature is abnormal based on the width of the recording medium and, when the first temperature is abnormal, interrupting the power supply to the heating source. An error in the temperature sensor is determined when a temperature difference between the first and second position of the fixing member is greater than a predetermined degree and the recording medium passes through both temperature sensors.

13 Claims, 7 Drawing Sheets

IMAGE FORMING APPARATUS AND ABNORMAL TEMPERATURE DETERMINATION CONTROLLING METHOD

CROSS-REFERENCE TO RELATED APPLICATIONS

This application claims the benefit of Korean Application No. 10-2009-0000709, filed Jan. 6, 2009, in the Korean Intellectual Property Office, the disclosure of which is incorporated herein by reference.

BACKGROUND OF THE INVENTION

1. Field of the Invention

Aspects of one or more embodiments relate to an image forming apparatus capable of improving safety with respect to overheating of a fixing unit thereof that fixes a toner image transferred onto a recording medium, and a controlling method thereof.

2. Description of the Related Art

Generally, an image forming apparatus produces an image on a recording medium in accordance with input signals. A printer, a copier, a facsimile, a multifunction apparatus having combined functions of the above and other similar functions or devices are included in the image forming apparatus.

An electro-photographic image forming apparatus comprises an electrifying unit, a laser scanning unit which is an exposing unit, a developing unit, a transfer unit and a fixing unit, which are all mounted around a photoconductive drum. A surface of the photoconductive drum is electrified to a predetermined potential by the electrifying unit and then exposed to the laser scanning unit, thereby forming an electrostatic latent image thereon. The developing unit develops a toner image according to the electrostatic latent image. The toner image is transferred to a recording medium and fixed on the recording medium by the fixing unit. Next, the recording medium having the image thereon is discharged to the outside.

The fixing unit heats and presses the recording medium upon which the toner image is transferred, thereby temporarily fusing the toner image in the form of powder, and fixing the toner image onto the recording medium.

For this purpose, the fixing unit comprises a fixing roller that fixes the toner on the recording medium, and a pressing roller pressing the recording medium toward the fixing roller. The fixing roller is equipped with a heating lamp mounted in the center thereof and is heated by a radiant heat of the heating lamp.

At one side of the fixing roller, a temperature sensor is installed in contact with an outer circumference of the fixing roller and comprises a thermistor to measure a surface temperature of the fixing roller. The thermistor measures the surface temperature of the fixing roller and transmits the measurement result to a control unit that controls the overall operations of the image forming apparatus. Then, the control unit switches a switching element based on the surface temperature of the fixing roller, thereby controlling power supplied to the heating lamp so that the surface temperature of the fixing roller can be maintained within a predetermined range.

However, in a case when the thermistor malfunctions due to an error or the control unit malfunctions due to factors such as static electricity, the surface temperature of the fixing roller may be measured as lower than the actual temperature or a temperature variation may not be accurately measured. In such cases, the heating lamp would be heated continuously, thereby damaging peripheral parts by overheating the peripheral parts.

SUMMARY OF THE INVENTION

Aspects of one or more embodiments provide an image forming apparatus capable of improving safety of a fixing unit by determining an error of a temperature sensor sensing a temperature of a fixing roller.

Aspects of one or more embodiments provide an image forming apparatus having a fixing member having a heating source heating a developer transferred to a recording medium, a power supply unit supplying electric power to the heating source, a first temperature sensor sensing a first temperature of a first position on the fixing member, a second temperature sensor sensing a second temperature of a second position on the fixing member, a width sensor sensing a width of the recording medium, and a control unit, when a difference between the first temperature and the second temperature is greater than a predetermined reference value, determining whether the first temperature is abnormal based on the width of the recording medium and, when the first temperature is abnormal, interrupting the power supply to the heating source.

Aspects of one or more embodiments provide a controlling method for an image forming apparatus having a fixing member having a heating source heating a developer transferred onto a recording medium, a first temperature sensor disposed at a first position in the middle of an outer circumference of the fixing member, and a second temperature sensor disposed at a second position near one end of the outer circumference of the fixing member, the controlling method including sensing a first temperature through the first temperature sensor and a second temperature through the second temperature sensor, determining whether a difference between the first temperature and the second temperature is equal to or greater than a predetermined reference value, detecting a width of the recording medium when the temperature difference is equal to or greater than the predetermined reference value, determining whether the first temperature is abnormal according to the width of the recording medium, and interrupting power supplied to the heating source if the first temperature is abnormal.

As described above, the image forming apparatus, according to aspects of one or more embodiments, is provided with temperature sensors disposed at the middle of and one side of the fixing roller and a width sensor that senses width of the recording medium. When a temperature difference between the side and the middle of the fixing roller is greater than a predetermined value and when the width of the recording medium is wide enough to pass through the both temperature sensors, it is determined that an error is generated at the temperature sensor, accordingly stopping the heating lamp and displaying an error message. As a consequence, damage of the fixing unit by overheating may be prevented.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
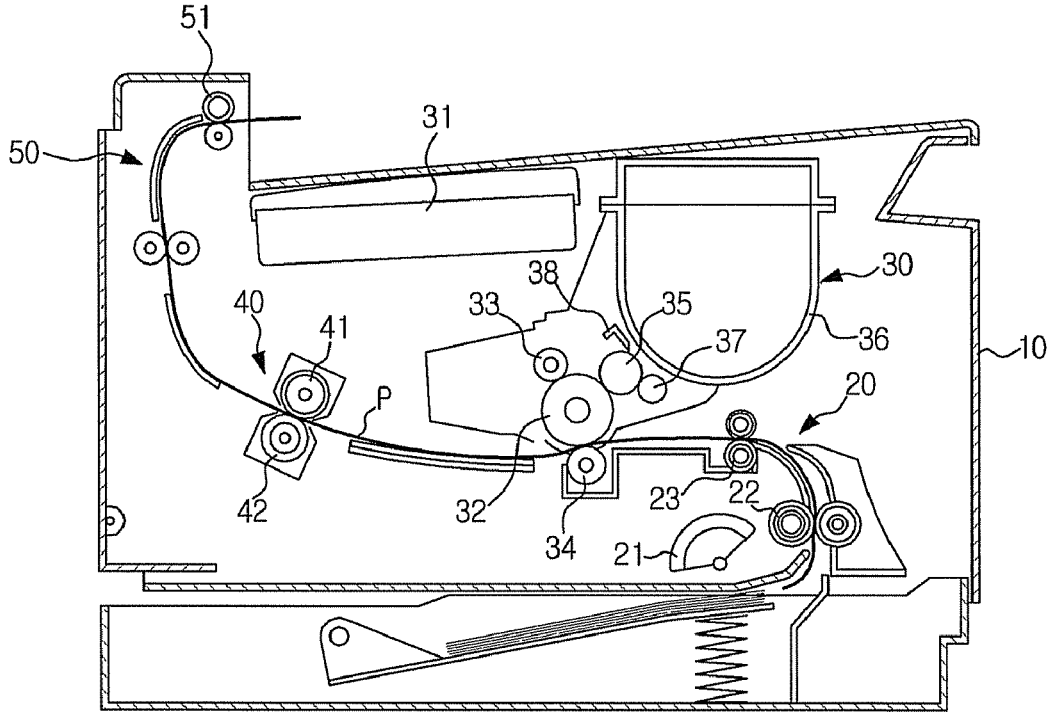
FIG. 1 is a sectional view schematically showing an image forming apparatus according to an embodiment.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a sectional view schematically showing an image forming apparatus according to an embodiment. As shown in FIG. 1, the image forming apparatus comprises a main body 10, a feeding unit 20 feeding a recording medium P into the main body 10, an image forming unit 30 forming an image on the recording medium P, a fixing unit 40 fixing the image formed at the image forming unit 30 onto the recording medium P, and a discharging unit 50 discharging the recording medium P. The recording medium P may include paper, envelopes, transparencies, printing labels, or other similar recording mediums, however, aspects of one or more embodiments of the present invention are not limited thereto.

The feeding unit 20 comprises a pickup roller 21 picking up the recording medium P stacked in a tray sheet by sheet, a feed roller 22 guiding feeding of the recording medium P picked up by the pickup roller 21, and a registration roller 23 rotatably mounted to arrange a leading end of the recording medium P fed by the pickup roller 21.

The image forming unit 30 comprises a laser scanning unit (LSU) 31 generating a laser beam, and an organic photo conductor (OPC) drum 32 rotatably mounted to form an electrostatic latent image according to digital image signals received from the LSU 31. The OPC drum 32 includes a charging roller 33 as a charging unit to electrically charge the OPC drum 32 to a predetermined potential, a transfer roller 34 as a transfer unit mounted at the main body 10 to form an image on the recording medium P, and a developing roller 35 as a developing unit to apply and develop toner on the electrostatic latent image formed on the OPC drum 32. The charging roller 33, the transfer roller 34 and the developing roller 35 are rotated in engagement with one another. Additionally, the developing roller 35 rotates in contact with a supply roller 37 by a predetermined nip, the supply roller 37 as a supply unit which supplies toner, or in other words, developer from a toner storage 36. The developing roller 35 and the supply roller 37 rotate in the same direction, thereby frictionally charging the toner and then supplying the toner to the developing roller 35. A doctor blade 38 is provided at an upper part of the developing roller 35 to restrict thickness of a toner layer applied on the developing roller 35. One end of the doctor blade 38 is fixed to a frame (main body 10) while the other end is in contact with the developing roller 35.

The fixing unit 40 fuses and fixes the toner image formed on the recording medium by the image forming unit 30 and comprises a heating roller 41 heating toner particles on the recording medium and a pressing roller 42 exerting a pressure on the recording medium, wherein the heating roller 41 and the pressing roller 42 are rotated in engagement with each other. The toner image transferred on the recording medium P is fixed onto the recording medium P by heat and pressure while passing between the heating roller 41 and the pressing roller 42.

The discharging unit 50 comprises a discharging roller 51 to discharge the recording medium P passed through the fixing unit 40 to the outside of the main body 10.

In addition, the image forming apparatus comprises a discharge sensor behind the fixing unit 40 to detect the recording medium P passing through the fixing unit 40.

The image forming apparatus further comprises a driving source generating a driving force, a power supply unit supplying electric power in the form of voltage or current respectively to the charging roller 33, the developing roller 35 and the transfer roller 34, and a control unit 60 controlling the overall operations.

Figure 2:
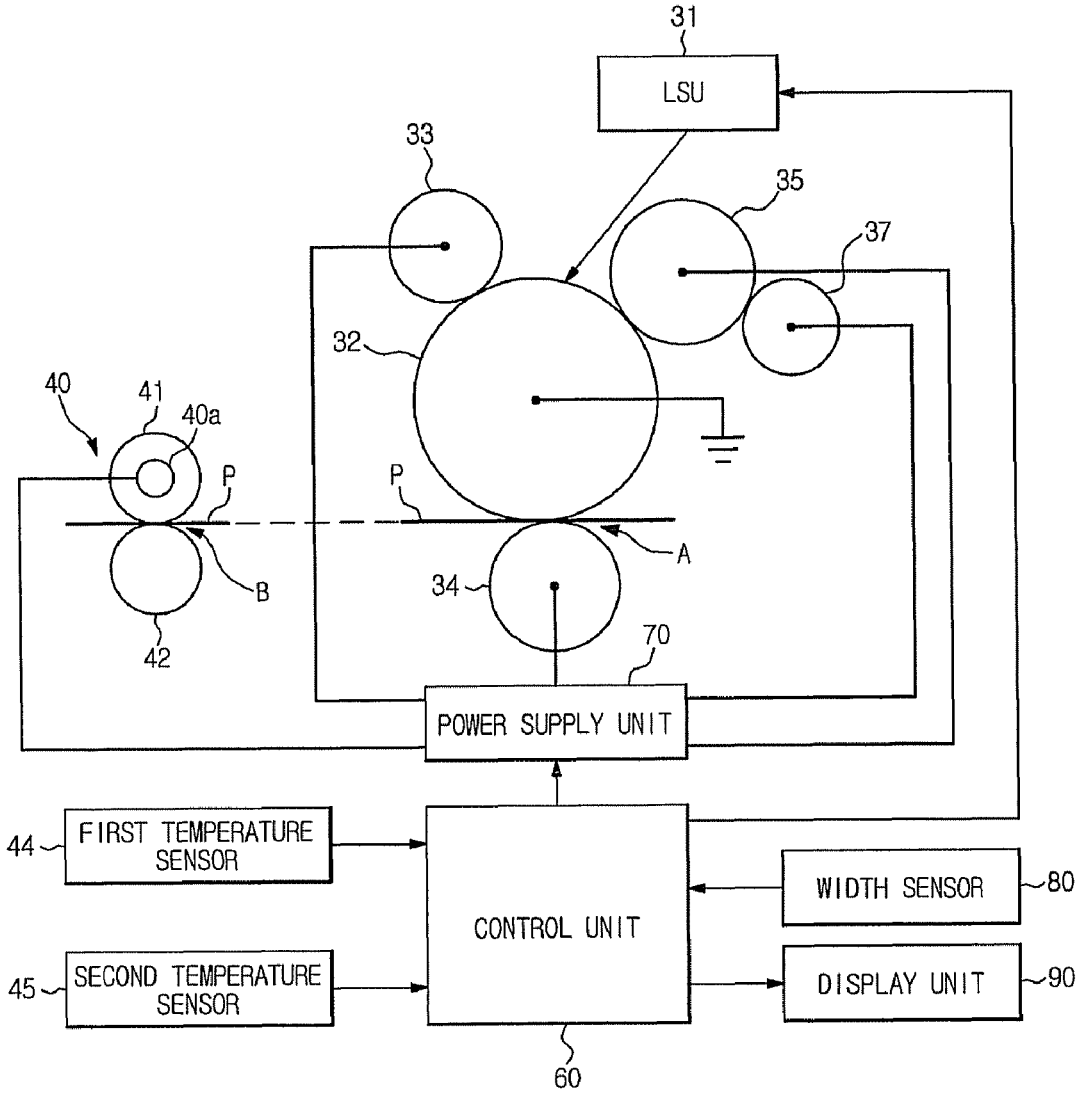
FIG. 2 is a schematic control block diagram of the image forming apparatus of FIG. 1.
Figure 3:
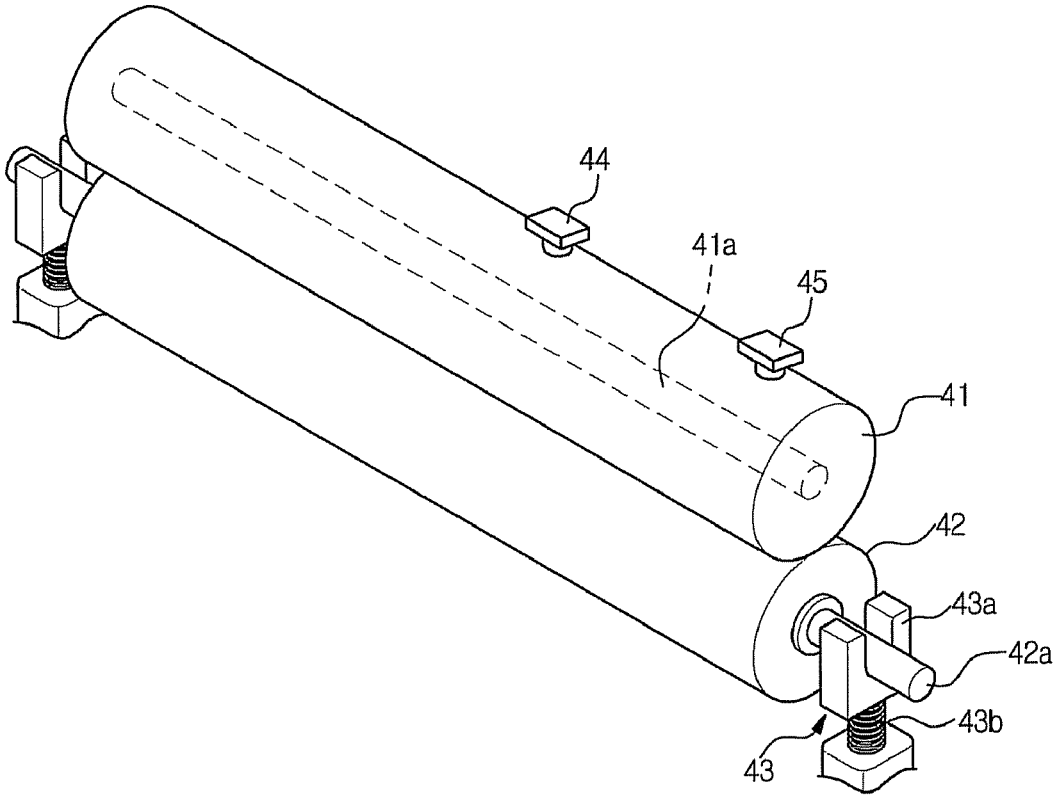
FIG. 3 is a perspective view of a fixing unit of the image forming apparatus of FIG. 1.

FIG. 2 is a control block diagram schematically illustrating the image forming apparatus according to the present embodiment. FIG. 3 shows the fixing unit of the image forming apparatus according to the present embodiment.

As shown in FIG. 2 and FIG. 3, the image forming apparatus comprises the control unit 60 and the power supply unit 70. For example, the power supply unit 70 supplies voltages for the charging roller 33, the transfer roller 34, the developing roller 35 and the supply roller 37, respectively. The power supply unit 70 also supplies power to a heating lamp 41*a* of the fixing roller 41.

The image forming processes are described hereinafter. According to a control signal of the control unit 60, the power supply unit 70 supplies a negative voltage to the charge roller 33. The charge roller 33 receiving the negative voltage charges the organic photoconductor (OPC) drum 32 to a negative potential. Since a potential difference occurs on the surface of the OPC drum 32 scanned with the laser beam by the laser scanning unit (LSU) 31, the electrostatic latent image is formed. The toner is supplied by the developing roller 35 and applied to the OPC drum 32 having the electrostatic latent image. At a transfer nip A formed by contact between the OPC drum 32 and the transfer roller 34, the toner image on the OPC drum 32 is transferred to the recording medium P by the transfer roller 34 supplied with a positive voltage from the power supply unit 70. At a fixing nip B formed by contact between the fixing roller 41 and the pressing roller 42, the transferred toner image is fixed on the recording medium P by heat of the heating lamp 40*a* mounted in the fixing roller 41 supplied with power from the power supply unit 70 and pressure of the pressing roller 42.

The fixing unit 40 comprises the fixing roller 41, the pressing roller 42, a pressing part 43, a first temperature sensor 44, and a second temperature sensor 45.

The fixing roller 41, being rotatably mounted, fixes the toner onto the recording medium P using heat. For this, the fixing roller 41 is heated by a radiant heat generated from the heating lamp 41*a* mounted through the center thereof.

The pressing roller 42 faces the fixing roller 41 and is rotated, thereby pressing the recording medium P against the fixing roller 41. To efficiently press the recording medium P, an outer surface of the pressing roller 42 may be formed of rubber. The pressing roller 42 also includes a rotating shaft 42*a* inserted therein to rotate the pressing roller 42.

The pressing part 43 exerts a pressure against the rotating shaft 42*a* of the pressing roller 42 so that the pressing roller 42 is able to press the recording medium P. The pressing part 43 comprises U-shape supporting guides 43*a* supporting both ends of the rotating shaft 42*a* of the pressing roller 42, and pressing springs 43*b* each connected to the supporting guide 43*a* with one end thereof to elastically bias the supporting guide 43*a* and generate a predetermined pressure on the pressing roller 42 toward the fixing roller.

The first temperature sensor 44 comprises a first thermistor formed is disposed at almost the middle of the fixing roller in the lengthwise direction of the fixing roller and is in contact with the outer circumference of the fixing roller 41 so as to sense a surface temperature of the fixing roller 41.

The second temperature sensor 45 comprises a second thermistor formed in contact with the outer circumference of the fixing roller 41 and is disposed near one end of the fixing roller 41 so as to sense a surface temperature of the fixing roller 41. The second temperature sensor 45 is mounted at a predetermined distance from the first temperature sensor 44, in such a manner that a line connecting the second temperature sensor 45 with the first temperature sensor 44 is axially parallel with the fixing roller 41. The first temperature sensor 44 is used to control the temperature of the heating lamp 41*a* whereas the second temperature sensor 45 is used to determine an abnormal heating state such as overheating of the first temperature sensor 44.

A width sensor 80 detects a width of the recording medium P and compares the width with a predetermined reference width. More specifically, when the width of the recording medium P is equal to or greater than the reference width, the width sensor 80 outputs a high signal and when the width of the recording medium P is less than the reference width, the width sensor outputs a low signal.

When a difference between a first temperature sensed by the first temperature sensor 44 and a second temperature sensed by the second temperature sensor 45 is greater than the predetermined reference value, the control unit 60 determines whether the first temperature is normal or abnormal based on the width of the recording medium P sensed by the width sensor 80. More specifically, the control unit 60 determines the first temperature to be normal when the width of the recording medium P is wide enough to pass through both the first and the second temperature sensors 44 and 45, and to be abnormal when the width of the recording medium P is so narrow as to pass through only the first temperature sensor 44. When the first temperature is abnormal, the control unit 60 interrupts power supplied to the heating lamp 41*a* in the fixing roller 41 through the power supply unit 70, so as to prevent overheating of the heating lamp 41*a*. Also, when the first temperature is abnormal, the control unit 60 displays an error message regarding the first temperature sensor 44 through a display unit 90.

Figure 4:
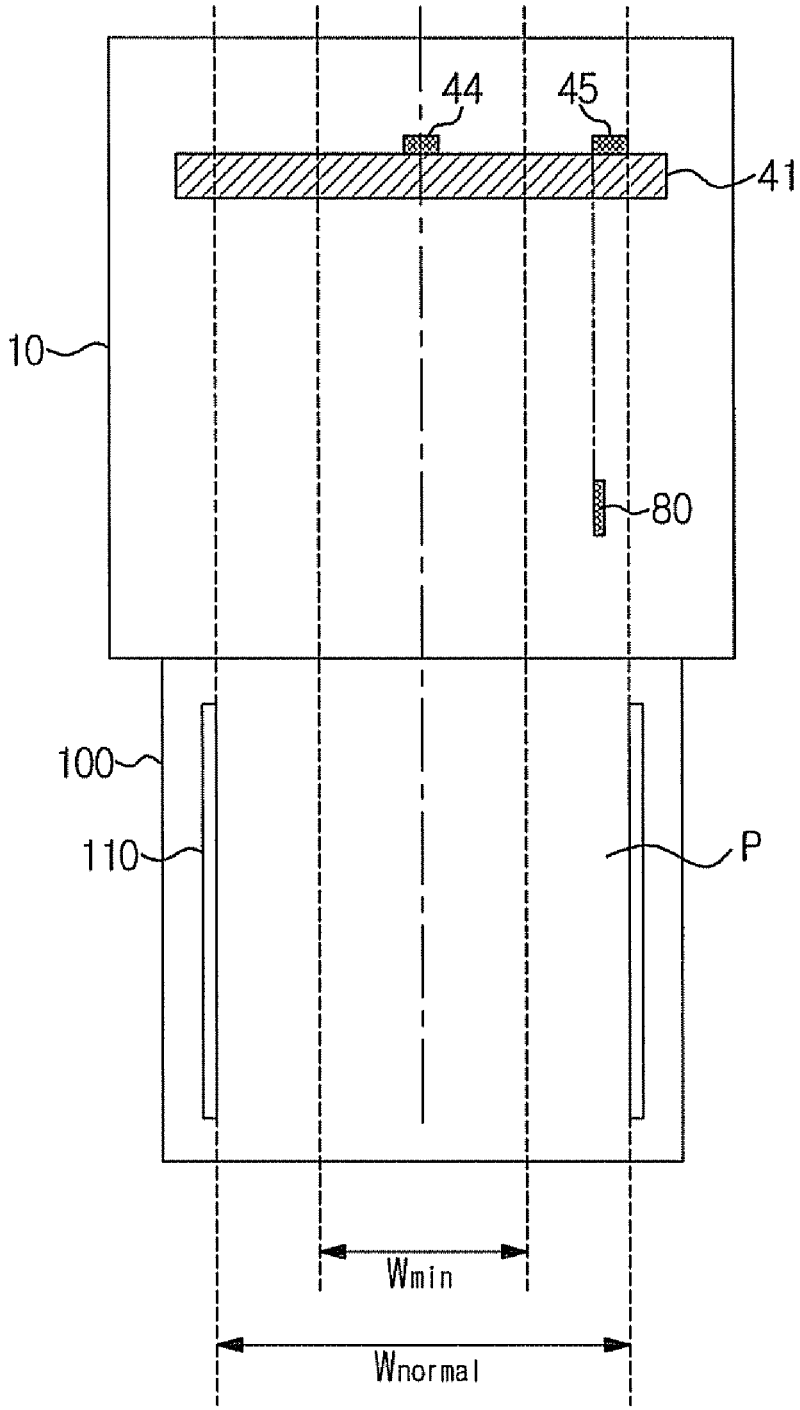
FIG. 4 is a view showing positional relationships among a recording medium, a first temperature sensor, a second temperature sensor, and a width sensor.

FIG. 4 shows positional relations among the recording medium, the first temperature sensor, the second temperature sensor, and the width sensor in the image forming apparatus.

Referring to FIG. 4, a reference numeral 10 denotes the main body of the image forming apparatus, 100 denotes the tray, and 110 denotes a feeding guide.

In the drawing, a dashed line passing through the middle of the fixing roller 41 indicates the middle of the recording medium P passing through the fixing roller 41. Dotted lines deviated from the middle of the fixing roller 41 respectively indicate a minimum width ($W_{MIN}$) and a normal width ($W_{NORMAL}$) of the recording medium P passing through the fixing roller 41.

The first temperature sensor 44 is disposed in the middle of the fixing roller 41 while the second temperature sensor 45 is disposed at a predetermined distance from the first temperature sensor 44 to the right.

The width sensor 80 is disposed on the right with respect to the dashed line passing through the middle of the fixing roller 41, at a position capable of detecting the normal width of the recording medium P.

The first temperature sensor 44 is disposed at a position to be passed through by the recording medium P having the minimum width when passing through the fixing roller 41, with respect to the dashed line passing through the middle. The second temperature sensor 45 is disposed at a position to be passed only by the normal-width recording medium but not by the minimum-width recording medium, with respect to the dashed line passing through the middle.

Figure 5:
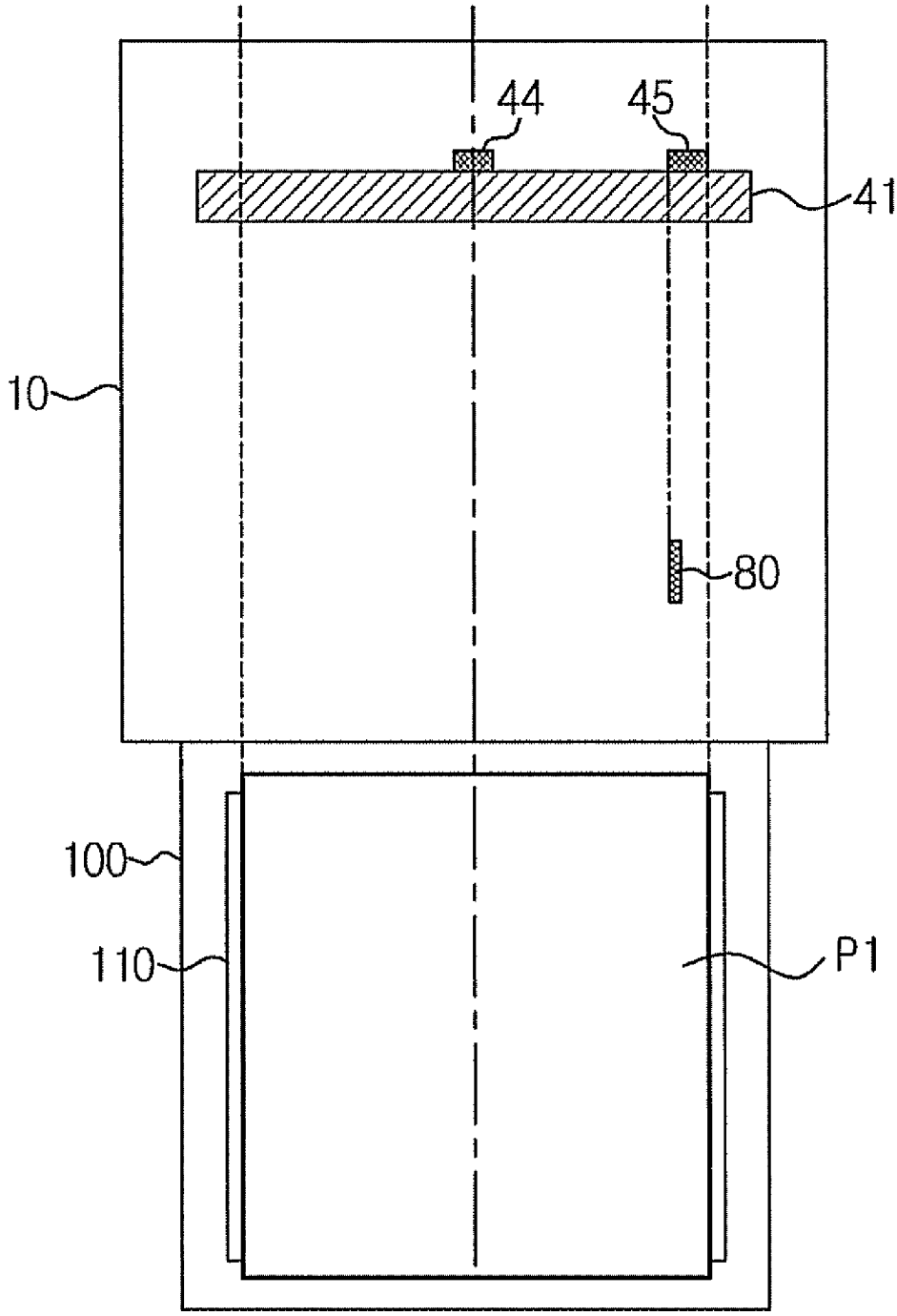
FIG. 5 shows a case in which a normal-width recording medium is fed through the image forming apparatus.
Figure 6:
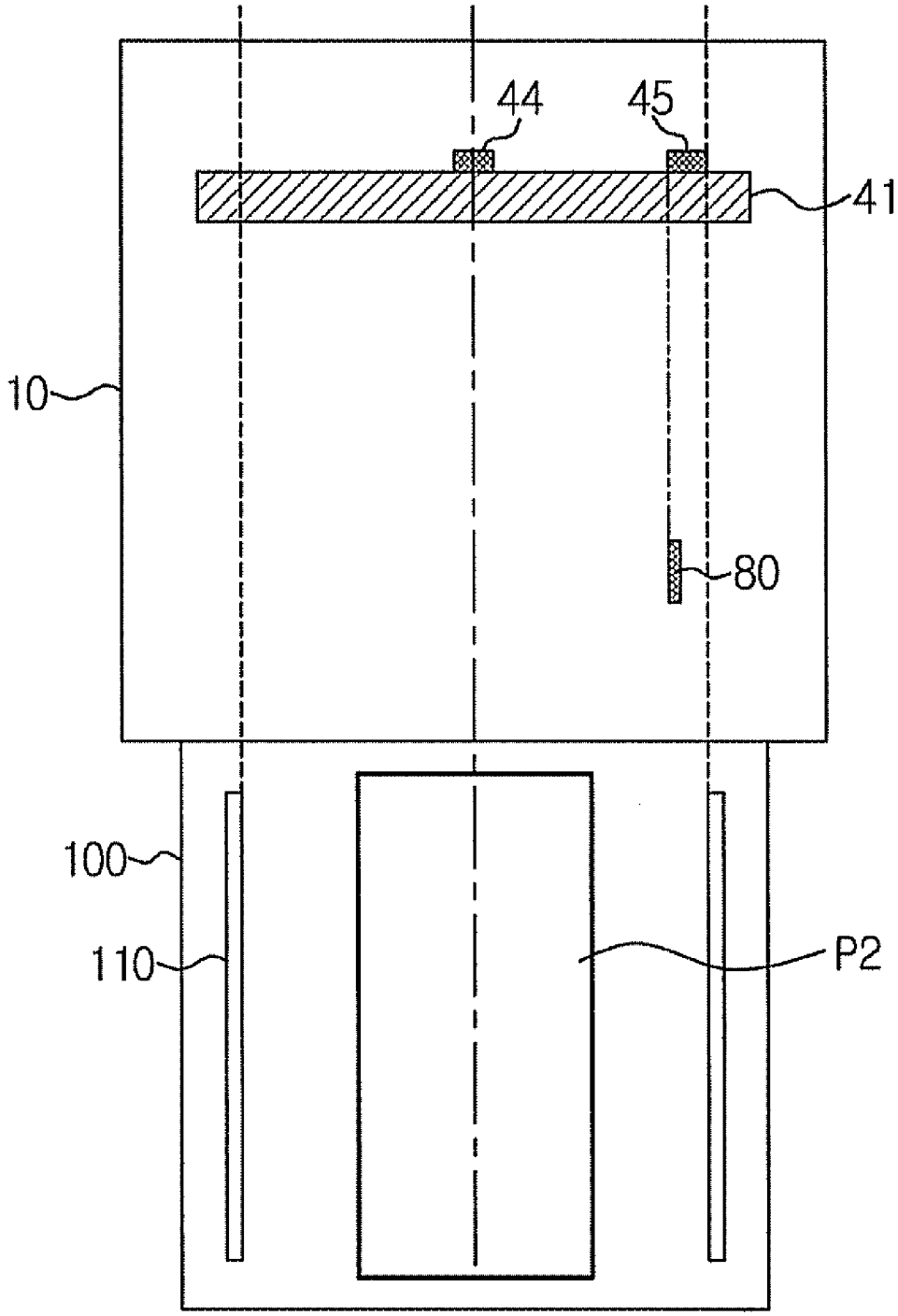
FIG. 6 shows a case in which a small-width recording medium is fed through the image forming apparatus.

FIG. 5 shows a case where the recording medium has a width wide enough to pass through both the first and the second temperature sensors. FIG. 6 shows a case where the recording medium has a width narrow enough to pass through only the first temperature sensor.

As shown in FIG. 5 and FIG. 6, for example, an A4 paper having a wide width (210 mm width×297 mm length) should pass through the width sensor 80 during feeding. Therefore, the high signal is output from the width sensor 80. On the other hand, in case of feeding a paper having a 70 mm width× 297 mm size, that is, having a ⅓ width of the A4 paper, the paper cannot pass through the width sensor 80. Therefore, the width sensor 80 outputs the low signal. That is, the width sensor 80 is disposed to output the high signal only when a paper having a width greater than a predetermined width is passed through the fixing roller 41. Accordingly, the width sensor 80 is capable of determining whether the recording medium is wide or narrow.

Also, the first and the second temperature sensors 44 and 45 are arranged on the fixing roller 41 such that the recording medium passing through the fixing roller 41 passes through both of the first and the second temperature sensors 44 and 45 when the recording medium has a wide width, and only the first temperature sensor 44 when the recording medium has a narrow width.

Figure 7:
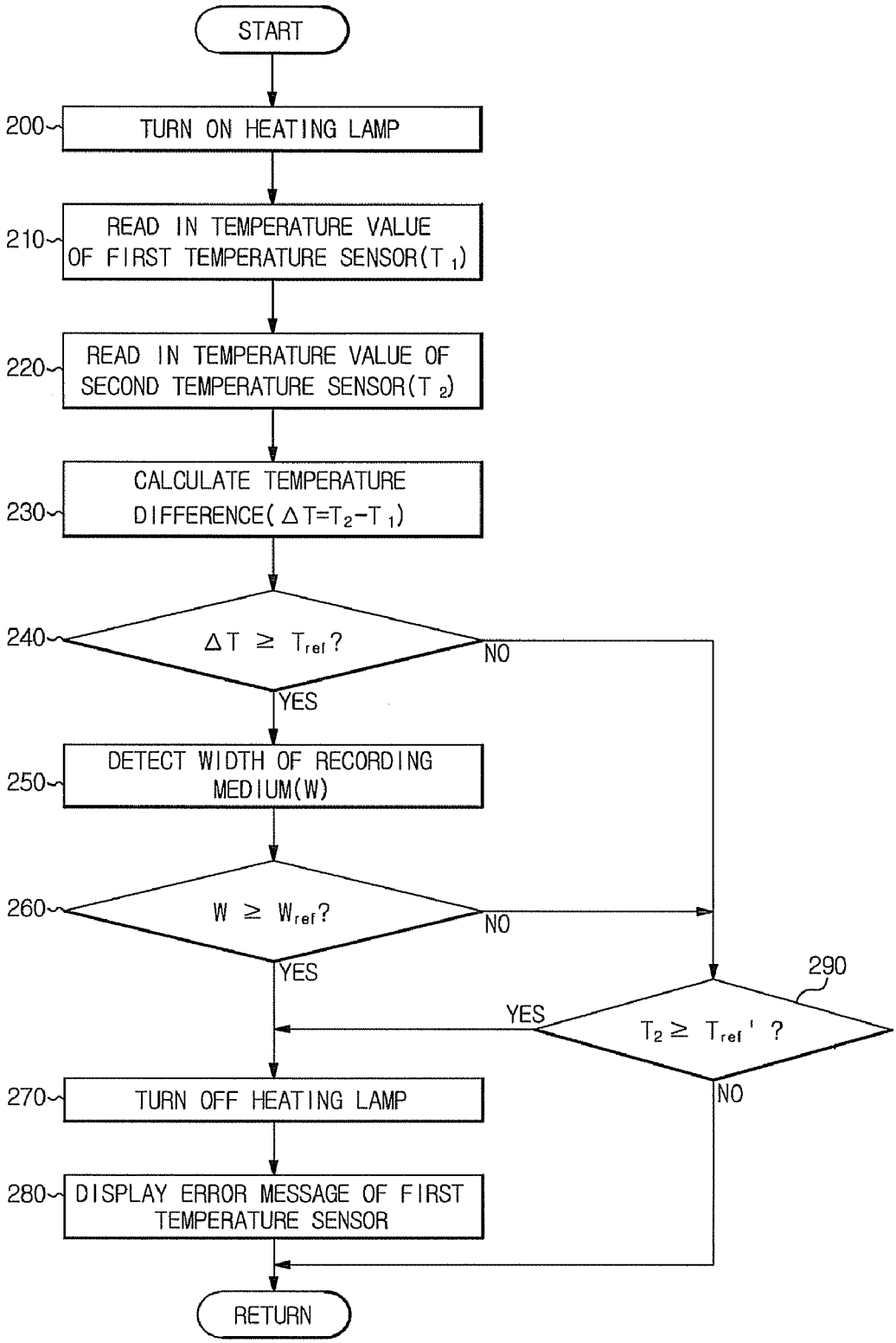
FIG. 7 is a control flowchart illustrating a controlling method of the image forming apparatus according to an embodiment.

FIG. 7 shows a method of controlling the image forming apparatus according to the embodiment.

Referring to FIG. 7, the control unit 60 turns on the heating lamp 41*a* by supplying power to the heating lamp 41*a* through the power supply unit 70 (operation 200).

After turning on the heating lamp 41*a*, the control unit 60 reads in the signal output from the first temperature sensor 44 (operation 210) and the signal output from the second temperature sensor 45 (operation 220).

After reading the output signals of the first and the second temperature sensors 44 and 45, the control unit 60 calculates a temperature difference between the first temperature T1 and the second temperature T2 corresponding to the read signals (operation 230).

Next, the control unit 60 compares the temperature difference to a first predetermined reference temperature Tref (operation 240). When the temperature difference is equal to or greater than the predetermined reference temperature Tref, the control unit 60 detects the width W of the recording medium through the width sensor 80 (operation 250).

After detecting the width W of the recording medium, the control unit 60 determines whether the width W is equal to or greater than a predetermined reference width Wref (operation 260) and, if so, the control unit 60 turns off the heating lamp 41*a* through the power supply unit 70 (operation 270), In addition, the control unit 60 displays an error message regarding the first temperature sensor 44 through the display unit 90 (operation 280).

On the other hand, in operation 240, if the temperature difference is less than the reference temperature Tref, the control unit 60 determines whether the second temperature T2 is equal to or greater than a second predetermined reference temperature Tref' (operation 290). If the second temperature T2 is equal to or greater than the second predetermined reference temperature Tref', the control unit 60 operates from operation 270. When the second temperature T2 is less than the second predetermined reference temperature Tref', the control unit 60 returns to the previous routine.

In operation S260, if the width of the recording medium is less than the reference width Wref, the control unit 60 determines whether the second temperature T2 is equal to or greater than the second predetermined reference temperature Tref' (operation S290). If the second temperature T2 is equal to or greater than the second predetermined reference temperature Tref', the control unit 60 operates from operation 270. When the second temperature T2 is less than the predetermined reference temperature Tref', the control unit 60 returns to the initial operation of the routine.

More particularly, during the printing, if the temperature difference ($\Delta T = T2 - T1$) between the first and the second temperatures T1 and T2 respectively sensed by the first and the second temperature sensors 44 and 45 is equal to or greater than 30° C., the width of the recording medium being fed is detected by the width sensor 80. When the recording medium has a relatively wide width and the temperature difference is nevertheless equal to or greater than 30° C., an error message is generated. When the recording medium has a relatively narrow width, the printing operation is continued. However, if the temperature sensed by the second temperature sensor is greater than the predetermined reference Tref', which indicates the overheated state, an error message is generated since it is determined that the first temperature sensor has a problem.

Furthermore, in case of an image forming apparatus according to still another embodiment, the first temperature sensor 44 is checked initially during a warming-up or standby mode. When a temperature of the first temperature sensor 44 reaches a ready temperature, the image forming apparatus turns to the standby mode. When the temperature of the first temperature sensor 44 has not reached the ready temperature, the image forming apparatus checks the second temperature sensor 45. If temperature of the second temperature sensor 45 has also not reached the ready temperature, the heating lamp 41*a* is turned on. When the temperature of the second temperature sensor 45 reaches the ready temperature first, the heating lamp 41*a* is checked as per being overheated. If the first temperature sensor 44 does not reach the ready temperature until the second temperature sensor 45 reaches a temperature value obtained by multiplying an increase of temperature per second by 3 (safety coefficient) and subtracting the multiplied value from a heat deflection temperature of the fixing unit, it is determined that the first temperature sensor 44 has an error. Accordingly, the error message of the first temperature sensor is generated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a fixing member having a heating source to heat a developer transferred to a recording medium;

a power supply unit supplying electric power to the heating source;

a first temperature sensor sensing a first temperature of a first position on the fixing member;

a second temperature sensor sensing a second temperature of a second position on the fixing member;

a width sensor sensing a width of the recording medium; and a control unit, when a difference between the first temperature and the second temperature is greater than a predetermined reference value, determining whether the first temperature is abnormal based on the width of the recording medium and, when the first temperature is abnormal, interrupting the power supply to the heating source, wherein the control unit determines the first temperature to be abnormal when the difference between the first temperature and the second temperature is greater than the predetermined reference value and also when the width of the recording medium in a fixing process is wide enough to pass through both the first and second temperature sensors.

2. The image forming apparatus according to claim 1, wherein the first position is disposed in the middle of the fixing member in a lengthwise direction of the fixing member and on an outer circumference of the fixing member, and the second position is disposed near one end of the fixing member in the lengthwise direction of the fixing member and on the outer circumference of the fixing member.

3. The image forming apparatus according to claim 2, wherein the second position is disposed at a predetermined distance from the first position.

4. The image forming apparatus according to claim 3, wherein the first position and the second position are disposed so that a line connecting the first position and the second position is axially parallel with the fixing member.

5. The image forming apparatus according to claim 1, further comprising a display unit to display an error of the first temperature or an error state of the first temperature sensor according to controlling signals of the control unit.

6. The image forming apparatus according to claim 1, wherein the first temperature sensor and the second temperature sensor are positioned on a same outer surface of the fixing member.

7. A controlling method for an image forming apparatus comprising a fixing member which includes a heating source heating a developer transferred onto a recording medium, a first temperature sensor disposed at a first position in the middle of an outer circumference of the fixing member, and a second temperature sensor disposed at a second position near one end of the outer circumference of the fixing member, the controlling method comprising:

sensing a first temperature through the first temperature sensor and a second temperature through the second temperature sensor;

determining whether a difference between the first temperature and the second temperature is equal to or greater than a predetermined reference value;

detecting a width of the recording medium when the temperature difference is equal to or greater than the predetermined reference value;

determining whether the first temperature is abnormal based on the width of the recording medium; and interrupting power supplied to the heating source if the first temperature is abnormal, wherein, when the width of the recording medium in a fixing process is wide enough to pass through both the first and second temperature sensors, the first temperature is determined to be abnormal.

8. The controlling method for an image forming apparatus according to claim 7, wherein the second temperature sensor is disposed on a same surface of the fixing member as the first temperature sensor.

9. An image forming apparatus, comprising:

a fixing member having a heating source;

a power supply unit supplying electric power to the heating source;

a first temperature sensor sensing a first temperature of a first position on the fixing member;

a second temperature sensor sensing a second temperature of a second position on the fixing member;

a width sensor sensing a width of a recording medium; and a control unit determining whether a difference between the first temperature and the second temperature is greater than a predetermined reference value and determining whether the first temperature is abnormal according to the detected width of the recording medium, wherein the first temperature sensor and the second temperature sensor are disposed on the fixing member such that the recording medium passes through both the first temperature sensor and the second temperature sensor when the recording medium has a wide width and the recording medium only passes through the first temperature sensor when the recording medium has a narrow width, wherein the control unit determines the first temperature to be abnormal when the difference between the first temperature and the second temperature is greater than the predetermined reference value and also when the width of the recording medium in a fixing process is wide enough to pass through both the first and second temperature sensors.

10. The image forming apparatus of claim 9, wherein the control unit disrupts the power supply to the heating source if determined that the first temperature is abnormal.

11. The image forming apparatus according to claim 9, wherein the second position is disposed at a predetermined distance from the first position.

12. The image forming apparatus according to claim 11, wherein the first position and the second position are disposed so that a line connecting the first position and the second position is axially parallel with the fixing member.

13. The image forming apparatus according to claim 9, further comprising a display unit to display an error of the first temperature or an error state of the first temperature sensor according to controlling signals of the control unit.

* * * * *